United States Patent [19]

Hoover et al.

[11] Patent Number: 4,562,583

[45] Date of Patent: Dec. 31, 1985

[54] SPECTRAL SLICING X-RAY TELESCOPE WITH VARIABLE MAGNIFICATION

[75] Inventors: Richard B. Hoover; Ernest Hildner, both of Huntsville, Ala.

[73] Assignee: The United States of America as represented by the Administrator of the National Aeronautics and Space Administration, Washington, D.C.

[21] Appl. No.: 571,613

[22] Filed: Jan. 17, 1984

[51] Int. Cl.[4] ..... G21K 7/00

[52] U.S. Cl. ..... 378/43; 378/85

[58] Field of Search ..... 350/559, 560, 570, 520, 350/522, 620; 378/43, 84, 85

[56] References Cited

U.S. PATENT DOCUMENTS 2,759,106 8/1956 Wolter ..... 378/43

3,821,556 6/1974 Hoover ..... 378/43

4,370,750 1/1983 Hoover ..... 378/43

*Primary Examiner*—Craig E. Church

*Attorney, Agent, or Firm*—Joseph H. Beumer; John R. Manning; Leon D. Wofford, Jr.

[57] ABSTRACT

A telescope (A) for viewing high frequency radiation. This telescope has a long focal length with a selection of magnifications despite a short housing (20). Light enters the telescope and is reflected by the telescope's primary optical system (10) and (12) to one of several secondary mirrors (14) at different locations on a movable frame (40). The secondary mirrors (14) have varying degrees of magnification and select narrow spectral slices of the incident radiation. Thus, both the magnification and effective focal length field of view and wavelength can be altered by repositioning moving frame (40).

8 Claims, 6 Drawing Figures

SPECTRAL SLICING X-RAY TELESCOPE WITH VARIABLE MAGNIFICATION

ORIGIN OF THE INVENTION

The invention described herein was made by employees of the United States Government and may be manufactured and used by or for the Government for governmental purposes without the payment of any royalties thereon or therefor.

TECHNICAL FIELD

This invention relates generally to a glancing incidence telescope and particularly to a spectral slicing x-ray telescope with variable magnification.

BACKGROUND ART

Glancing incidence telescopes such as the Wolter x-ray telescopes are typically used to focus the x-rays from a point source (or an extended source) at infinity to a high resolution image on the sensitive surface of the detector situated at the prime focus of the Wolter telescope. For soft x-rays (wavelengths ranging from 2Å to 100Å), the Wolter type I mirror system with concave paraboloidal and hyperboloidal elements (all of which are coaxial, confocal and internally reflecting) is typically used. Such telescopes were flown on the Skylab space station and have been used on the Einstein and Copernicus observatories in space. For very soft x-rays and extreme ultraviolet (XUV) radiation (100Å to 600Å) range Wolter type II systems are typically used. These differ from the Wolter I configuration by virtue of the fact that the second reflecting element is a convex, externally reflecting hyperboloid usually mounted partially within the confines of the paraboloidal mirror. In some cases, to improve off-axis performance, the exact contours of these elements are modified in accordance with the Wolter-Schwarzschild configuration. A number of these systems have been built and flown on sounding rockets, and on the Apollo spacecraft.

Historically, the spatial resolution of glancing incidence x-ray telescope systems has been limited by the detector used rather than the x-ray optics. High spatial resolution x-ray detectors (such as photographic film) tend to be of low quantum efficiency; whereas high quantum efficiency detectors tend to have intrinsically low spatial resolution characteristics. Hence to use a device such as a charged coupled device (CCD), which is extremely sensitive over a very broad wavelength range, it is necessary to have an x-ray telescope of very great focal length to achieve a plate scale that allows high resolution imagery with the CCD. Very long telescopes are typically heavy, and in space applications they pose significant mobility constraints upon the launch vehicle, instrument pointing system, alignment tolerances, and thermal control system.

Alteration of the telescope plate scale can be achieved by coupling the Wolter mirror system to the detector by a relay optic system such as a glancing incidence hyperboloid/ellipsoid x-ray microscope optic. The resultant system still has a longer physical length than the focal length of the Wolter mirror system, but the length of this system is very much less than that which would be required if one simply designed the Wolter optic to provide the equivalent plate scale. The primary disadvantage of this approach is that the x-ray microscope optics equipment is extremely expensive. Furthermore, the alignment tolerances are tight and the system must be provided with appropriate thermal control to insure that the microscope optic remains with its front focal plane accurately positioned on the primary focal plane of the Wolter mirror system. Also, the microscope provides no spectral discrimination, although this would be considered an advantage if the microscope optic were used to feed a high-spectral-resolution crystal spectrometer.

The approach of using the x-ray microscope optic to give the system a long effective focal length has one further disadvantage when compared with the present invention. Once the microscope magnification has been chosen, it becomes fixed, thus rigidly fixing the resultant field of view. The mirrors of the present invention are sufficiently simple to build and inexpensive that many can be used, each of which provides a different effective focal length, field of view, and the same or different spectral slice. The spectral slicing x-ray telescope can be used somewhat like a zoom lens, with the magnification, spectral slice, and field of view altered simultaneously by simply positioning a different hyperboloidal mirror into the converging x-ray beam.

A significant disadvantage of the prior art lies in the use of thin foils as filter materials for obtaining spectral information. The great overlap in the spectral response of various filters as well as their wide bandpass make these filters have very limited value. Also, these devices are of virtually no value in the very soft x-ray/XUV region since to transmit the long wavelengths they must be very thin, making them pass harder radiation as well. There is great difficulty in fabricating very thin window filters, and they must be suspended upon some type of support mesh. These filters are also very prone to failure due to their inherently low structural strength. Recently, however, this situation has been somewhat improved by fabrication of filters composed of multiple layers of several different elements.

DISCLOSURE OF THE INVENTION

In the invention described herein, a properly configured, convex, hyperbolic layered synthetic microstructure mirror is introduced into a beam converging toward the prime focus after having been reflected by a glancing incidence mirror near the entrance of the light beam in the telescope. This hyperbolic layered mirror is located at the positive portion of a hyperbola with a positive focus which coincides with the prime focus of the telescope mirror system. This mirror then selectively reflects a narrow spectral slice of the incoming radiation toward the negative focus of the hyperbola just described. It is in the position of this second focus that the detector is situated. The exact wavelength that is effectively reflected is determined by the nature and thickness of layers which constitute the layered synthetic microstructure mirror. To alter the magnification of the system, a wheel may be provided which carries a number of such mirrors, mounted on the ends of rods or hollow cylinders of different lengths. If the position of the detector remains the same, changing the position of the surface of the hyperboloidal layered synthetic microstructure mirror alters both the magnification and field of view of the telescope system which results. The effective focal length can be varied by making the mirrors out of differently contoured synthetic microstructures and placing them at different positions along the focal length.

Accordingly, an important object of the present invention is to provide a glancing incidence x-ray telescope having improved spatial, temporal, and spectral resolution.

Another important object is to provide an x-ray telescope which has a very long effective focal length, but which is compact in size.

Still another important object of the present invention is to provide an x-ray telescope of variable magnification which is simple in construction and inexpensive to fabricate.

Yet another important object of the present invention is to provide an x-ray telescope having a system of specially structured hyperbolic mirrors which provide different effective focal lengths, field of view, and the same or different spectral slice.

BRIEF DESCRIPTION OF THE DRAWINGS

Referring now to the drawings.

DESCRIPTION OF A PREFERRED EMBODIMENT

Figure 1:
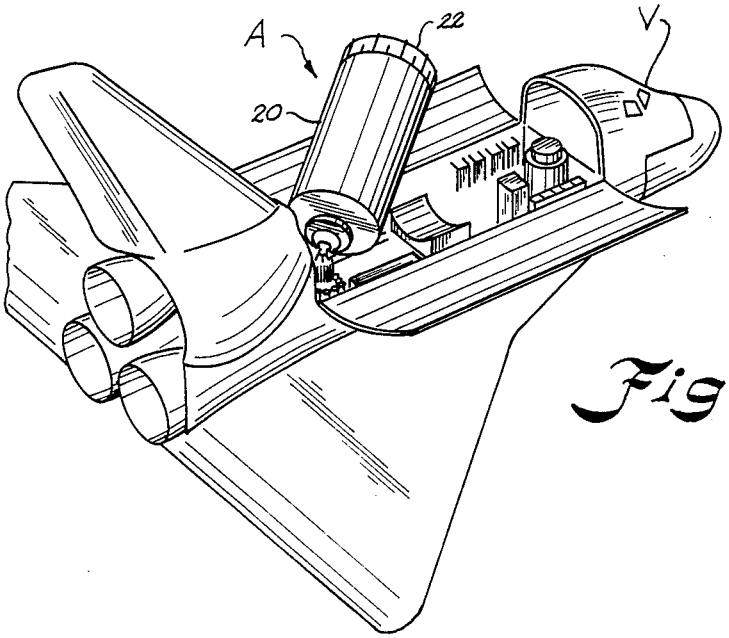
FIG. 1 is a pictorial view illustrating one form of this invention secured to a space shuttle.

The invention relates to a spectral slicing x-ray telescope with variable magnification designated at A in FIG. 1. This telescope has particular application to missions in space. FIG. 1 illustrates the telescope as aimed from the payload bay of a space shuttle vehicle V.

Figure 2:
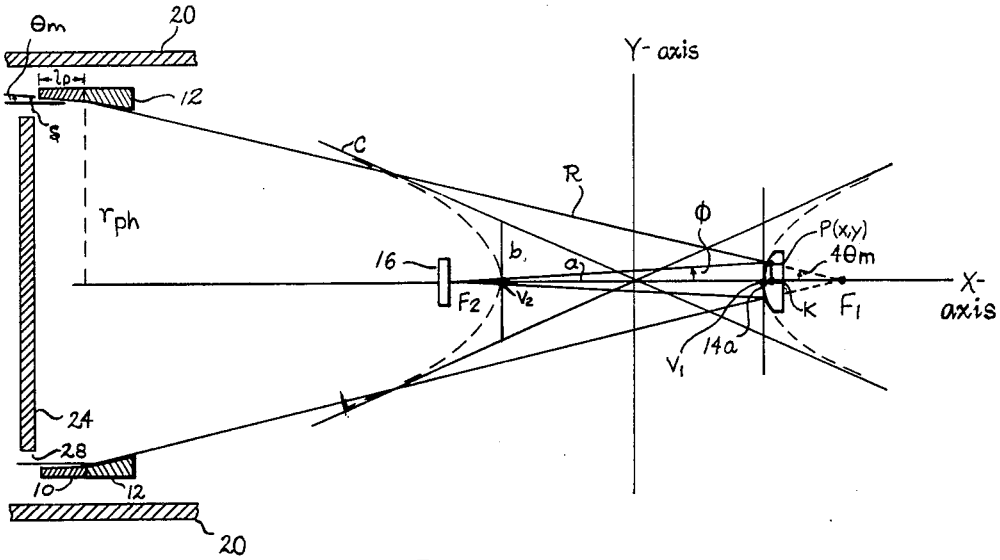
FIG. 2 is a schematic view of the interior of this invention showing the mathematically determined locations of the mirrors.
Figures 3, 3A:
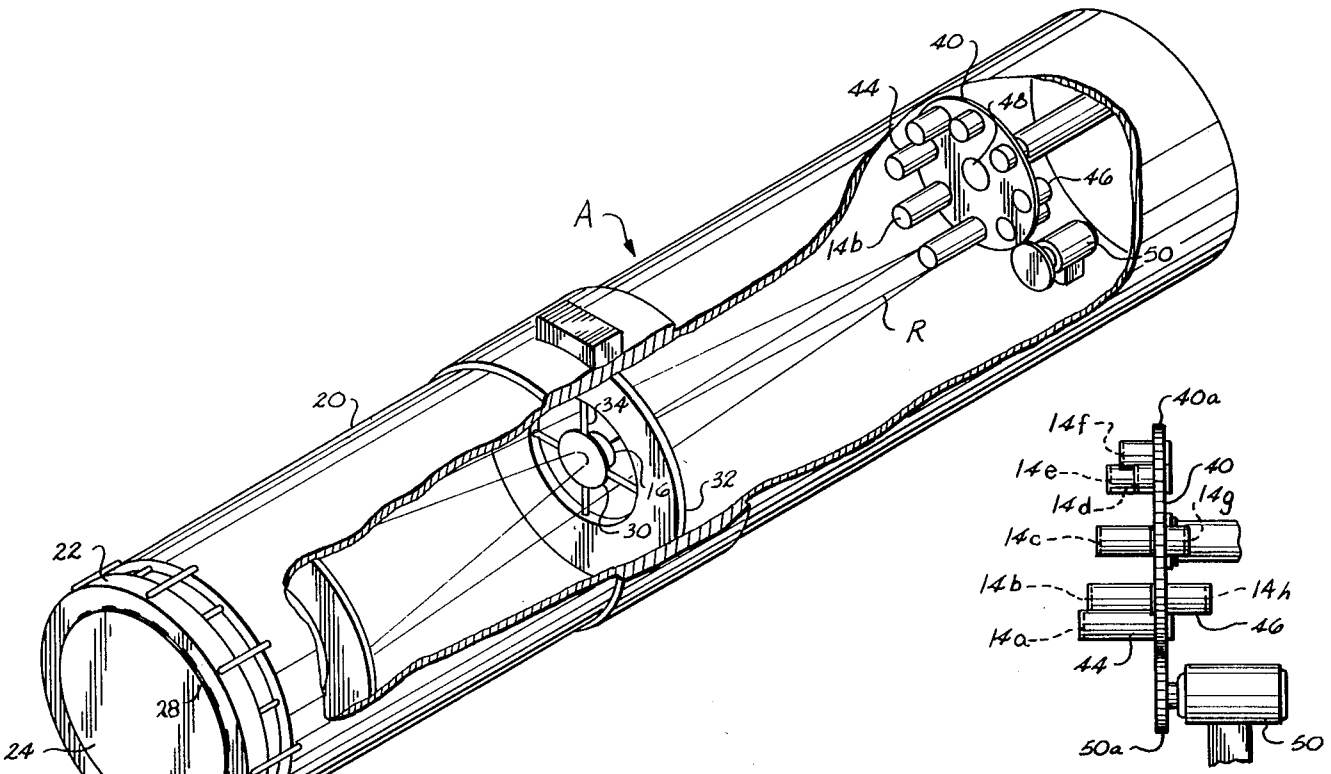
FIG. 3 is a perspective view, partially broken away, showing the internal structure of this invention nested in its housing.
FIG. 3*a* is a side view of the hyperbolic mirrors attached to a wheel which rotates in front of the primary focus of incoming light beams.

Referring now to FIG. 3, which is a perspective view with parts cut away, a preferred form of the invention is illustrated utilizing an un-nested Wolter I mirror as the primary optical element. The optical and mechanical components are housed within a telescope tube 20 that is constructed of beryllium or other suitable structural material. The telescope tube may then be mounted to a spar or base plate (not shown) which is mounted to an appropriate pointing control system (not shown). Mounted to the front of tube 20 there is a heat shield/-prefilter 22 complete with one or more front stops 24 affixed to the heat shield support by means of spiders 26 to form an entrance annulus 28. As shown in FIG. 2, x-rays from the sun or a distant cosmic x-ray source pass through entrance annulus 28 and strike the primary optical system mirrors 10 and 12. Rays hit the paraboloidal mirror 10 at a glancing angle of incidence. Paraboloid mirror 10 reflects the x-ray to hyperboloidal mirror 12 which further reflects them toward the prime focus F (FIG. 2) of the Wolter I mirror system. Some x-rays may strike the hyperboloid mirror 12 without having been reflected first by the paraboloid 10 and these are deviated toward a region known as the hyperboloid "pseudo-focus". At this place, referring back to FIG. 3, there is a conventionally mounted second stop 30 affixed to an annular mount ring 32 by means of spiders 34. In the preferred embodiment, the detector 16, which may be a CCD, microchannel plate or other high sensitivity x-ray detector, is mounted on the back surface of second stop 30.

As shown in FIG. 3 situated in front of the prime focus of the Wolter mirror system is a rotatable wheel 40 on which are mounted a plurality of reflecting elements 14*a*, 14*b*, 14*c*, etc., in the form of convex hyperboloidal secondary mirrors. These mirrors 14*a*, 14*b*, 14*c*, etc., may be carried on cylindrical elements as configured on the end surface of rods 44, or on the bottom of hollow cylinders 46. The mathematically determined location of these mirrors 14*a*, 14*b*, 14*c*, etc., are later described in further detail.

Selection means for positioning a desired mirror 14*a*, 14*b*, 14*c*, etc., in a reflecting position on the optical axis of the primary system is provided by the wheel 40 which is rotated about center axis 48 by means of a stepper motor 50. As shown in FIG. 3*a*, a gear wheel 50*a* is carried on the output shaft of the stepper motor 50 which wheel meshes with gear teeth 40*a* carried on the circumference of the wheel 40. These components are carefully machined and aligned such that at each operating position of the wheel 40, the optical axis of the convex mirror mounted by means of 44 or 46 is accurately coincident with the optical axis of the primary x-ray optic comprised of mirrors 10 and 12 (FIG. 2). The position of the convex hyperboloidal mirror 14*a*, 14*b*, 14c, etc., on the optical axis determines the effective focal length of the optical system, and therefore the resultant magnification.

The forward mirrors 14*a*, 14*b*, 14*c*, 14*d*, 14*e*, and 14*f* on the rods 44 provide low magnifications, whereas the aft mirrors further away from the detector 16 (mirrors 14*g* and 14*h* at the base of the hollow cylinders 46) provide high magnifications. It should be noted that the mirrors 14*g* and 14*h* at the base of hollow cylinders 46 are still convex hyperboloidal elements with their first focus coincident with the prime focus of the Wolter system and their second focus on the focal plane of detector 16. The combination of rods 44 and hollow cylinders 46 allows greater variations in magnification to be achieved while keeping the length of the longest rod or cylinder as short as possible.

Although only eight mirrors, 14*a* through 14*h*, are shown in this drawing, in practice it would be desirable to have far more than this mounted on the wheel. This is due to the fact that each mirror selects only one narrow spectral slice of the incoming radiation and reflects it to detector 16. For example, a practical embodiment would include twenty-four reflecting elements. There would be four groups of six mirrors having a magnification power of 1.5, 4, 8, and 12. There would be one mirror in each group coated to reflect a wavelength of 30Å, 44Å, 67Å, 113Å, 256Å, and 304Å. These mirrors are made from different layered synthetic microstructure configurations, such that each reflects only a selected spectral slice of the x-ray spectrum. For best results each mirror should be composed of many (100–1000) alternate layers of materials such as tungsten and carbon, gold and aluminum, aluminum and beryllium, or magnesium and gold and should be constructed by layered synthetic microstructure techniques, such as sputtering, which are known by prior art to reflect x-rays at or near normal incidence by serving as synthetic Bragg diffractors. The exact nature of the coatings and thickness of the alternating layers determine the particular wavelength that is effectively reflected. The layers used are usually very thin, of the order of 7Å to 40Å. With the current technology, good reflectivities (i.e. 10% to 30%) can be achieved with layered synthetic microstructure mirrors reflecting a beam R at normal incidence over the wavelength range from 30Å to 400Å or more. To some extent, the mirror coating can be tailored to select a desired spectral slice. Hence, in the preferred embodiment of the invention there would be a plurality of mirrors, each of which is tailored to reflect a different wavelength and deposited on the ends of rods of identical length. This would afford images at identical magnifications and field of view for several different wavelength regions. There would also be several rod or cylinder lengths represented, to allow the magnification and field of view to be altered as desired.

The surface of each mirror element would be ground and polished to the desired convex hyperboloidal figure as determined by the equations and parameters to be discussed. Each reflecting mirror element 14*a*, 14*b*, 14*c*, etc., will be polished to a high finish surface (root-mean-square roughness less than 6–8 Å) but this is well within the current state of the art of optical polishing technology.

The rotary type wheel 40 can best be seen in FIG. 3*a*, but it should be pointed out that a variety of other means may be utilized to move the desired convex layered synthetic microstructure coated hyperboloidal mirror 14*a*, 14*b*, 14*c*, etc, into the appropriate position on the optical axis of the primary glancing incidence x-ray mirror 12 (FIG. 2) and still remain within the scope and spirit of this invention.

To further understand the optical ray path through the spectral slicing x-ray telescope system having variable magnification according to the invention, reference is made to FIG. 2. X-rays which enter the telescope through the entrance annulus 28, are channeled around front stop 24 to be parallel to the optical axis, here depicted as the x-axis. In accordance with the manner in which Wolter I mirror systems operate, these x-rays strike cylindrical concave, internally reflecting parabolic mirror 10 and are deflected to cylindrical concave, internally reflecting hyperbolic mirror 12. Both mirror 10 and mirror 12 are conventional elements of a Wolter type I telescope's x-ray mirror system. These two elements are coaxial about the optical axis that in this figure is shown to coincide with the optical axis or abscissa designated X. In accordance with standard glancing incidence x-ray telescope techniques, paraboloid mirror 10 and hyperboloid mirror 12 are confocal about the primary focus which lies on the optical axis X. Mirror 12 then deviates these x-rays along x-ray beam R such that they would cross the optical axis, here designated the x-axis at the focal spot designated by $F_1$ if they were not first deflected by convex internally reflecting mirror 14*a*, 14*b*, 14*c*, etc. The mirror 14*a* is positioned such that its face, which beam R will strike, is shaped like and located in the same position as the positive portion of a hyperbola with $F_1$ as the focal point and with the x-axis as its principal axis. Procedures for determining the requisite focal points and directrices of the hyperbola are described below. Since a single mirror 14*a* can be smaller than 0.5 inches, utilization of multiple convex hyperboloidal mirrors in place of a single mirror is preferable. These mirrors can be mounted in selected spots in front of, on, or behind a disk type wheel 40 (as shown in FIG. 3) so that they may be sequentially rotated into the x-ray beam R. The mirror 14*a* has the dual function of magnifying the x-rays coming from mirror 12, while reflecting only a narrow spectral portion of the broadband x-rays and extreme ultraviolet (XUV) radiation to x-ray detector 16. The detector 16 is located at the negative focal point $F_2$ which corresponds to $F_1$. Although any detector capable of detecting x-rays in a two-dimensional array will suffice, a detector capable of functioning well in both the soft x-ray and XUV range such as a charge coupled device (CCD) is most desirable.

To determine mathematically the optimum size and shape of a mirror, the following steps should be taken. First, the desired magnification must be established, taking the desired resolution and the plate scale of the telescope into consideration. The magnification, M, can be manipulated using the formula:

$$M = \frac{\tan 4\theta m}{\tan \phi}$$

Where $\theta$m represents the glancing angle of incidence incoming x-rays upon the paraboloid mirror (10), and $\phi$ is the angle the x-ray diffracting from the mirror 14*a* to the reflector 18 makes with the optical, or x-axis. Thus $4\theta$ is the angle which the rays make as they cross the optical axis at focal point $F_1$. Next, the shape of the mirror 14*a* is determined using the standard formula for a hyperbola. A hyperbola with the x-axis as its principal axis and with foci $F_1$: (ae,o) and $F_2$: (−ae, o) and corresponding directices X =a/e and X =−a/e is:

$$\frac{X^2}{a^2} - \frac{Y^2}{b^2} = \left(\frac{X}{a} - \frac{Y}{b}\right)\left(\frac{X}{a} + \frac{Y}{b}\right) = 1$$

where a and b are positive numbers and $b^2=a^2(e^2-1)$. "X" and "Y" represent the hyperbola's coordinates on the x-axis and y-axis respectively. Referring to FIG. 2, "a" is represented by the distance between the origin and the point closest to the origin which mirror 14*a* crosses the x-axis. "b" is represented by the vertical distance between the x-axis and the point at which a line drawn perpendicular to the x-axis at the point (−a,o) crosses the asymptote "C". "e" is the constant ratio of the eccentricity of the conic.

The distance of focal point $F_1$ from the origin can be determined using simple trigonometry. Now, $$|F_1k| + |F_2k| = 2ae$$

By substitution:

$$|F_2k| \frac{(\tan 4\theta m)}{\tan \phi} + |F_2k| = 2ae$$

$$|F_2k|(M + 1) = 2ae$$

Since values for $|F_1k|$, and $4\theta$m are known simple trigonometry can be used to find $PF_1$. Similarly, known values for $|F_2k|$, S can be used to find $PF_2$ by simple trigonometry. Also, $$PF_2 - PF_1 = 2a$$

$$\frac{|F_2k|(M + 1)}{PF_2 - PF_1} = \frac{2ae}{2a} = e$$

The following mathematical steps are helpful in determining a and e: knowing $|V_1V_2| = 2a$ and $|F_1F_2| = 2ae$ it follows that:

$$\tan \phi = \frac{Pk}{|F_2k|}$$

and $$\tan 4\theta m = \frac{Pk}{|F_1k|}$$

Therefore:

$$|F_2k| = \frac{Pk}{\tan \phi}$$

and $$|F_1k| = \frac{Pk}{\tan 4\theta m}$$

Thus, $$M = \frac{|F_2k|}{|F_1k|} = \frac{\frac{Pk}{\tan \phi}}{\frac{Pk}{\tan 4\theta m}} = \frac{\tan 4\theta m}{\tan \phi}$$

tan 4θm and tan φ are known values, since they can be measured.

Thus, $$|F_1k| = \frac{|F_2k|(\tan \phi)}{(\tan 4\theta m)}$$

The minimum radius of the hyperboloid mirrors 14*a*, 14*b*, 14*c*, etc., required to intercept paraxial rays is given by $r_{phmin} = (F_1K) \tan 4\theta m$. In actually these mirrors should be slightly larger $r_{phmin}$ to accommodate off-sources rays from extended sources. From examination of FIG. 2, $$\tan \theta m = \frac{}{l_p}; \quad = l_p \tan \theta m:$$

where $1_p$ = length of paraboloid mirror 10. Substituting these two given numbers into the following equation for calculating the geometrical area (A) of the primary mirror element 10:

$$A = \pi(r_{ph} + S)^2 - \pi r_{ph}^2$$

where $1_p$ = paraboloid length and $r_{ph}$ = radius at the intersection of paraboloid 10/hyperboloid 12

Thus:

$$A = \pi(r_{ph} + 1_p \tan\theta m)^2 - \pi r_{ph}^2.$$

Figures 4, 4A:
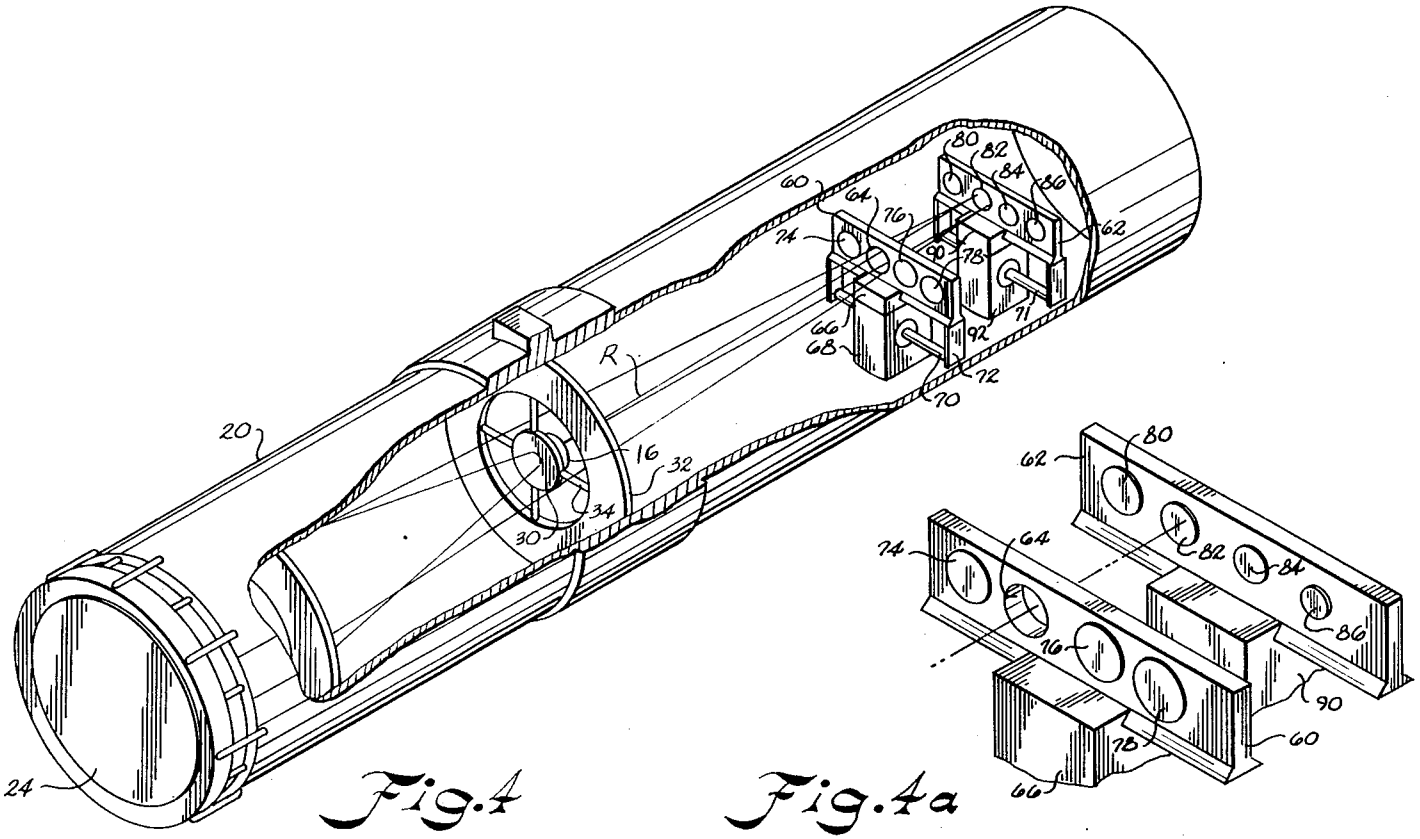
FIG. 4 is a sectional perspective view, partially broken away, of an alternate embodiment of the invention in which convex hyperboloidal mirrors are introduced into the beam without use of a rotatable wheel.

One alternate embodiment of the invention is encompassed by a different means of introducing the mirrors 14*a*, 14*b*, 14*c*, etc., into the beam at the appropriate position along the optical axis. Referring now to FIG. 4, in which the convex hyperboloidal mirrors are introduced into the beam R without the means of a rotatable wheel. In this embodiment, there are a plurality of properly machined tracks forward 66 and aft 90, constructed of metal or other suitable material, and mounted on the interior wall of the telescope tube 20.

Each track 66 or 90 slidably carries a precisely machined plate 60 or 62 which supports the mirror to be introduced into beam R similarly as mirror 14*a*, 14*b*, 14*c*, etc., on the rotatable wheel of FIG. 3. In this embodiment, the mirrors are identified as 74, 76, 78 on front plate 60 and as mirrors 80, 82, 84 and 86 on aft plate 62, but they obviously perform similarly to mirror 14*a* of FIG. 2. The front plate 60 has an aperture 64 for allowing the beam R to pass unaltered to the aft mirrors on plate 62 when they are to be placed in use.

The mirrors on plates 60 and 62 have multiple convex hyperboloidal, layered synthetic microstructured structures of different diameters and convexity and thus, magnification.

The size of these mirrors on plates 60 and 62 is determined by the position along the optical axis at which they are located by the plates 60 and 62. Thus, the mirrors 74, 76, 78 on forward plate 60 are nearer to the detector 16 and therefore are larger in diameter than aft mirrors 80, 82, 84 and 86 on aft plate 62 which are further away. The aft mirrors 80, 82, 84 and 86 are smaller in diameter than the forward mirrors 74, 76, and 78 and therefore provide an image with higher magnification and more restricted field of view when used with a detector 16 of limited sensitive area.

The front and aft plates 60 and 62 carrying the mirrors are driven to slide along tracks 66 and go by step motors 68 and 92 acting through worm gear rods 70, 71 and end member 72, 73 on the plates, respectively. For example, to utilize one of the low magnification mirrors 74, 76 and 78, the step or stepper motor 68 is activated to move its gear rod 70 and thus the desired mirror until its optical axis is centered upon the optical axis of the entire telescope system. To utilize the aft mirrors 80, 82, 84 and 86 for high magnification, step motor 92 moves its gear rod 71 and the aft plate 62 to position the desired mirror onto the optical axis, and step motor 68 moves plate 60 until the open aperture 64 permits the incoming beam R to pass to the select aft mirror. This embodiment may give greater structural stability and allow more convex hyperboloidal mirrors to be used than afforded by the wheel approach.

Other embodiments envisioned include a system wherein the detector 16 is mounted on the front stop 24 or at some other position along the optical axis rather than on the second stop 30 as previously described.

Thus, it can be seen that a highly advantageous zoom x-ray telescope may be had according to the invention which improves spatial resolution with high sensitivity detectors. The magnification afforded by the convex hyperboloidal mirror allows high sensitivity detectors capable of operating over a very broad range of wavelengths to be used without degradation of the spatial resolution provided by the primary Wolter mirror system. The use of high sensitivity detectors is very important as it allows the observations to be obtained with much shorter exposure times, thus affording significantly greater temporal resolution than is possible with slow detectors, such as photographic film.

The greater wavelength coverage allows different regions of the solar atmosphere to be investigated. For example, high resolution images of the transition region in the 100Å and 200Å wavelength regime have not as yet been obtained. Since the convex hyperboloidal mirror is operating at normal incidence, the beam direction is reversed. This allows for very long effective-focal-length systems to be achieved with a telescope of small physical length. This results in a significant reduction in the instrument weight, and hence simplifies spacecraft usage problems such as launch, pointing, and thermal control.

The invention also facilitates high spectral resolution in the soft x-ray/XUV regime. The layered synthetic microstructure coatings of the mirrors behave as Bragg diffractors and effectively reflect only a very narrow spectral slice of the incoming radiation. This affords spectral resolution that is far greater than that achieved previously with thin metallic foil filters. Furthermore, these coatings allow spectral resolution in ranges that are not suitable for the thin foil type filters, i.e. soft x-ray/XUV. For example, these coatings can be tailored to reflect only XUV radiation around 300Å. However, any ordinary thin film filter capable of transmitting 330Å XUV radiation would of necessity also transmit the harder x-rays in the 6Å to 100Å range arriving from the sun and reflected by the primary mirrors. Hence, this configuration provides a very powerful tool for investigating the soft x-ray/XUV region, which has previously been an extremely difficult region from an observational point of view.

While a preferred embodiment of the invention has been described using specific terms, such description is for illustrative purposes only, and it is to be understood that changes and variations may be made without departing from the spirit or scope of the following claims.

We claim:

1. A telescope adapted to receive x-ray and extreme ultraviolet radiation beams, said telescope comprising:

a telescope housing, with a front opening for transmitting radiation, at least one front stop connected to said front opening of said telescope housing to prevent unwanted incoming radiation from interfering with the desired operation of the telescope, a glancing incidence primary optical system comprised of at least one mirror at the front entrance of the telescope for reflecting incoming radiation toward a principle focus on the primary optical axis, a plurality of secondary mirrors in front of the primary focal point along the primary optical axis, a high sensitivity x-ray and extreme ultraviolet light detector located at the secondary focal point along the primary optical axis, a mounting means for holding said secondary mirrors, and a selection means for choosing the appropriate secondary mirror.

2. In a telescope according to claim 1, wherein said mounting means comprises:

a wheel with a plurality of cylinders projecting therefrom, and said secondary mirrors attached to one end thereof.

3. In a telescope according to claim 2, wherein said mounting means comprises:

a wheel with a plurality of hollow cylinders projecting perpendicularly therefrom, and said secondary mirrors attached to one end thereof.

4. In a telescope according to claim 2, wherein said mounting means comprises:

a wheel with a plurality of cylinders projecting perpendicularly therefrom in front of and a plurality of hollow cylinders projecting perpendicularly behind the wheel, said wheel having an aperture in front of said cylinders projected behind it, said aperture for transmitting light to the secondary mirror behind it, and said secondary mirrors positioned at one end thereof.

5. In a telescope according to claim 4 wherein the mounting means comprises:

said secondary mirrors positioned at the end of the cylinders furthest from the wheel.

6. A telescope adapted to receive an x-ray or extreme ultraviolet radiation beam, said telescope comprising:

a telescope housing with a front opening for admitting radiation, at least one front stop connected to said front opening of said telescope housing to prevent incoming radiation from interfering with the detector inside the telescope, a glancing incidence primary optical system comprised of at least one mirror at the front entrance of the telescope for reflecting incoming radiation toward a principal focus on the primary optical axis, a plurality of secondary mirrors near the primary focal point along the primary optical axis, a mounting means for holding said secondary mirrors, said means being a plurality of sliding plates adjacent the primary focal point, said plates being located one in front of another, the front plates having an aperture for light to go through to reach the rear plates, and a selection means for moving said sliding plates to position the appropriate secondary mirror in front of the focal point.

7. A telescope in accordance with claim 6, wherein at least two of the secondary mirrors have a different layered synthetic microstructure coating to enhance the reflectivity of a desired wavelength of radiation.

8. A telescope in accordance with claim 6, wherein at least two secondary mirrors are located at ends of cylindrical rods attached to said plates.

* * * * *